US007385881B2

(12) United States Patent
Huang

(10) Patent No.: US 7,385,881 B2
(45) Date of Patent: Jun. 10, 2008

(54) DISPLAY MODE CONTROL METHOD FOR AN ELECTRONIC DEVICE

(75) Inventor: Yu-Chien Huang, Yun-Lin Hsien (TW)

(73) Assignee: Mitac International Corp., Hsinchu Hsien (TW)

( * ) Notice: Subject to any disclaimer, the term of this patent is extended or adjusted under 35 U.S.C. 154(b) by 84 days.

(21) Appl. No.: 11/376,702

(22) Filed: Mar. 15, 2006

(65) Prior Publication Data

US 2006/0209096 A1 Sep. 21, 2006

(30) Foreign Application Priority Data

Mar. 18, 2005 (TW) ..... 94108364 A

(51) Int. Cl.
*G04B 19/26* (2006.01)

(52) U.S. Cl. ..... 368/82; 368/239; 368/223

(58) Field of Classification Search ..... 368/82, 368/239, 223
See application file for complete search history.

(56) References Cited

U.S. PATENT DOCUMENTS 3,841,083 A * 10/1974 Bergey ..... 368/67
4,669,891 A * 6/1987 Rosevear ..... 368/21
4,996,632 A * 2/1991 Aikens ..... 362/560
6,333,608 B1 * 12/2001 Kawauchi et al. ..... 315/308
6,359,839 B1 * 3/2002 Schenk et al. ..... 368/16
6,507,286 B2 * 1/2003 Weindorf et al. ..... 340/815.75
6,683,822 B2 * 1/2004 Cheng ..... 368/240
6,847,173 B2 * 1/2005 Berthou et al. ..... 315/169.3
6,894,440 B2 * 5/2005 Cristoni et al. ..... 315/291
7,106,048 B1 * 9/2006 Feight et al. ..... 324/127
7,198,372 B2 * 4/2007 Aeling et al. ..... 353/30
2002/0008808 A1 * 1/2002 Adams ..... 349/65
2003/0103419 A1 * 6/2003 Cheng ..... 368/240
2003/0168998 A1 * 9/2003 Cristoni et al. ..... 315/291
2004/0057226 A1 * 3/2004 Berthou et al. ..... 362/31
2004/0218401 A1 * 11/2004 Okubo et al. ..... 362/526
2004/0243307 A1 * 12/2004 Geelen ..... 701/213
2006/0015818 A1 * 1/2006 Chaudhri et al. ..... 715/779
2006/0218051 A1 * 9/2006 Westberg ..... 705/26
2007/0115209 A1 * 5/2007 Maejima ..... 345/46

* cited by examiner

*Primary Examiner*—Gary F. Paumen
(74) *Attorney, Agent, or Firm*—Trop, Pruner & Hu, P.C.

(57) ABSTRACT

A display mode control method includes the steps of: enabling an electronic device to determine the time of day; and enabling the electronic device to operate a display panel thereof in a first display mode when the time of day corresponds to nighttime, and in a second display mode when otherwise. The display panel shows information in a light shade against a dark background when operated in the nighttime display mode, and in a dark shade against a light background when operated in the daytime display mode.

4 Claims, 3 Drawing Sheets

DISPLAY MODE CONTROL METHOD FOR AN ELECTRONIC DEVICE

CROSS-REFERENCE TO RELATED APPLICATION

This application claims priority of Taiwanese Application No. 094108364, filed on Mar. 18, 2005.

BACKGROUND OF THE INVENTION

1. Field of the Invention

This invention relates to a display mode control method, more particularly to a display mode control method for switching operation of a display panel of an electronic device between daytime and nighttime display modes automatically.

2. Description of the Related Art

Electronic devices employing global positioning system (GPS) technology are well known in the art. Such electronic devices are typically used in a vehicle, and include a display panel that shows navigational map information and that is operable in daytime and nighttime display modes. In the daytime display mode, the navigational map information is shown on the display panel in a dark shade against a light (such as white) background. During nighttime, since the light background can be a source of distraction and discomfort to the viewer's eye, the display panel is operated in the nighttime display mode. In this mode, the navigational map information is shown on the display panel in a light shade against a dark (such as black) background.

The aforementioned conventional electronic devices are disadvantageous in that switching operation of the display panel between the daytime and nighttime display modes is done manually, which is inconvenient on the part of the vehicle driver.

SUMMARY OF THE INVENTION

Therefore, the object of the present invention is to provide a display mode control method for switching operation of a display panel of an electronic device between daytime and nighttime display modes automatically.

According to one aspect of invention, a display mode control method, which is to be implemented in an electronic device that has a display panel, comprises the steps of: enabling the electronic device to determine the time of day; and enabling the electronic device to operate the display panel in a first display mode when the time of day corresponds to nighttime, and in a second display mode when otherwise.

According to another aspect of the invention, a display mode control method, which is to be implemented in an electronic device that has a display panel for showing navigational map information, comprises the steps of: enabling the electronic device to determine the time of day; and enabling the electronic device to operate the display panel in a nighttime display mode when the time of day corresponds to nighttime, and in a daytime display mode when otherwise. The navigational map information is shown on the display panel in a light shade against a dark background when the display panel is operated in the nighttime display mode, and in a dark shade against a light background when the display panel is operated in the daytime display mode.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
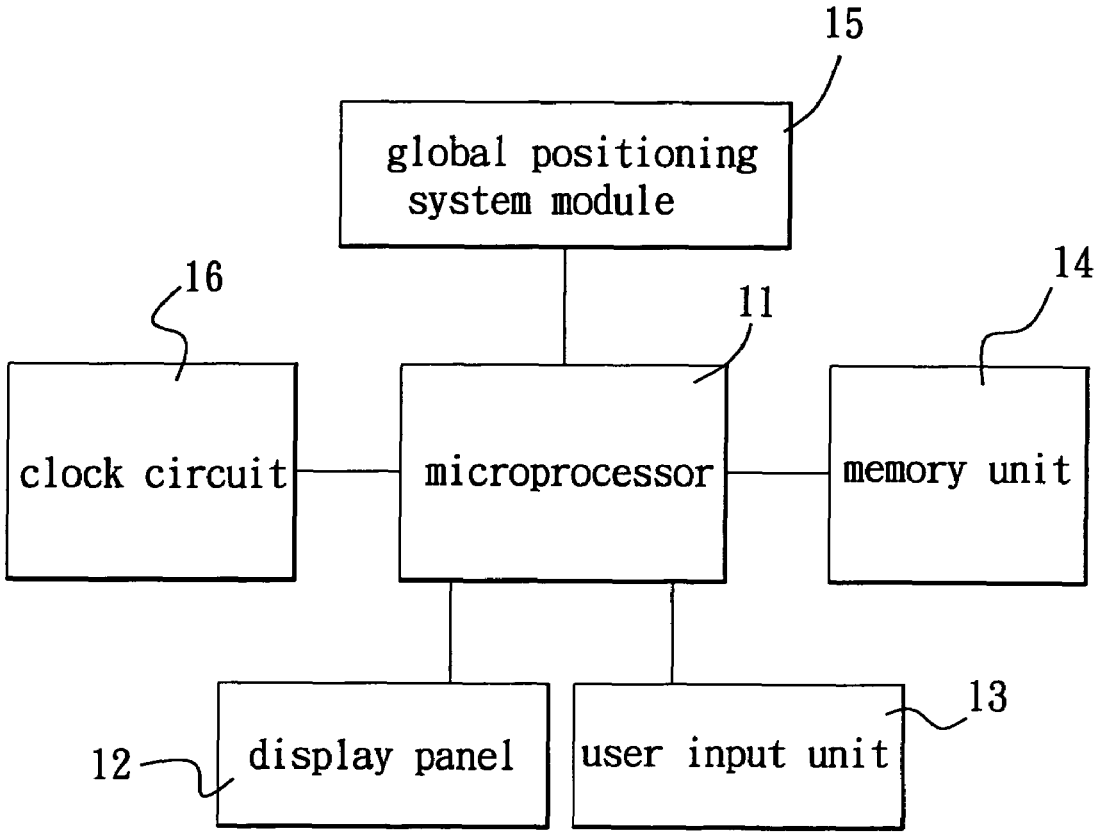
FIG. 1 is a schematic block diagram of an electronic device for implementing the preferred embodiment of a display mode control method.

Referring to FIG. 1, an electronic device for implementing the preferred embodiment of a display mode control method according to this invention is shown to include a microprocessor 11, a display panel 12, a user input unit 13, a memory unit 14, a global positioning system module 15, and a clock circuit 16.

In this embodiment, the electronic device is a handheld electronic device, such as a personal digital assistant (PDA). Alternatively, the electronic device is a navigational device installed in a vehicle.

The display panel 12 is coupled to and is controlled by the microprocessor 11 so as to show navigational map information, and is operable in daytime and nighttime display modes. When the display panel 12 is operated in the daytime display mode, the navigational map information is shown on the display panel 12 in a dark (such as black) shade against a light (such as white) background. On the other hand, when the display panel 12 is operated in the nighttime display mode, the navigational map information is shown on the display panel 12 in a light (such as white) shade against a dark (such as black) background, thereby sparing the driver (not shown) from glare on the display panel 12 during night driving.

The user input unit 13 is coupled to the microprocessor 11, and is operable so as to accept inputs from the user for configuring the electronic device.

The memory unit 14 is coupled to the microprocessor 11, stores the navigational map information, and is programmed with instruction codes for execution by the microprocessor 11.

The global positioning system (GPS) module 15 is coupled to the microprocessor 11, and is operable so as to receive signals, which contain coordinates of the electronic device, from a GPS service provider (not shown). The display panel 12 is further controlled by the microprocessor 11 so as to show the coordinates contained in the signals received by the GPS module 15 relative to the navigational map information, in a manner well known in the art.

The clock circuit 16 is coupled to the microprocessor 11, and is operable so as to generate the time of day. In this embodiment, the microprocessor 11 and the clock circuit 16 are separate components. In an alternative embodiment, the clock circuit 16 is embedded in the microprocessor 11.

The microprocessor 11 enables operation of the display panel 12 in nighttime and daytime display modes based on the time of day generated by the clock circuit 16, in a manner that is described hereinafter.

Figure 2:
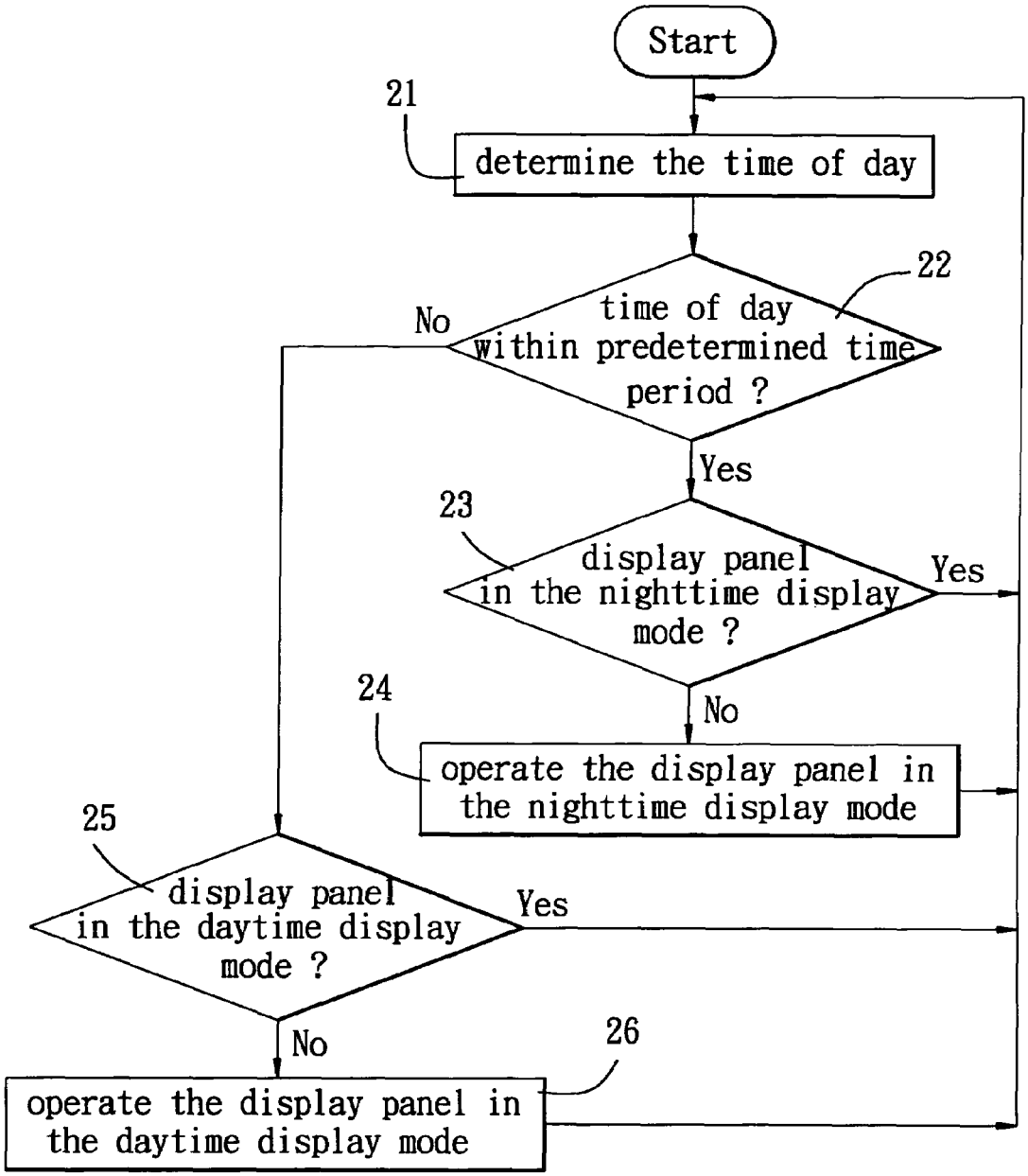
FIG. 2 is a flowchart of the preferred embodiment of the display mode control method according to this invention.

The preferred embodiment of a display mode control method, which is implemented using the aforementioned electronic device, according to this invention includes the steps shown in FIG. 2.

In step 21, the microprocessor 11 of the electronic device determines the time of day generated by the clock circuit 16.

In step 22, if the microprocessor 11 of the electronic device verified that the time of day determined in step 21 is within a predetermined time period, the flow proceeds to step 23. Otherwise, the flow proceeds to step 25.

In this embodiment, the predetermined time period corresponds to nighttime, and is defined by start and end times. The start and end times are user configurable and are respectively set at 7:00 PM and 6:00 AM by default.

In step 23, if the microprocessor 11 of the electronic device verified that the display panel 12 is already operating in the nighttime display mode, the flow goes back to step 21. Otherwise, the flow proceeds to step 24.

In step 24, the microprocessor 11 of the electronic device enables operation of the display panel 12 in the nighttime display mode. Thereafter, the flow goes back to step 21.

In step 25, if the microprocessor 11 of the electronic device verified that the display panel 12 is already operating in the daytime display mode, the flow goes back to step 21. Otherwise, the flow proceeds to step 26.

In step 26, the microprocessor 11 of the electronic device enables operation of the display panel 12 in the daytime display mode. Thereafter, the flow goes back to step 21.

It is noted herein that the aforementioned display mode control method of this invention is in the form of instruction codes programmed in the memory unit 14 and executed by the microprocessor 11.

Figure 3:
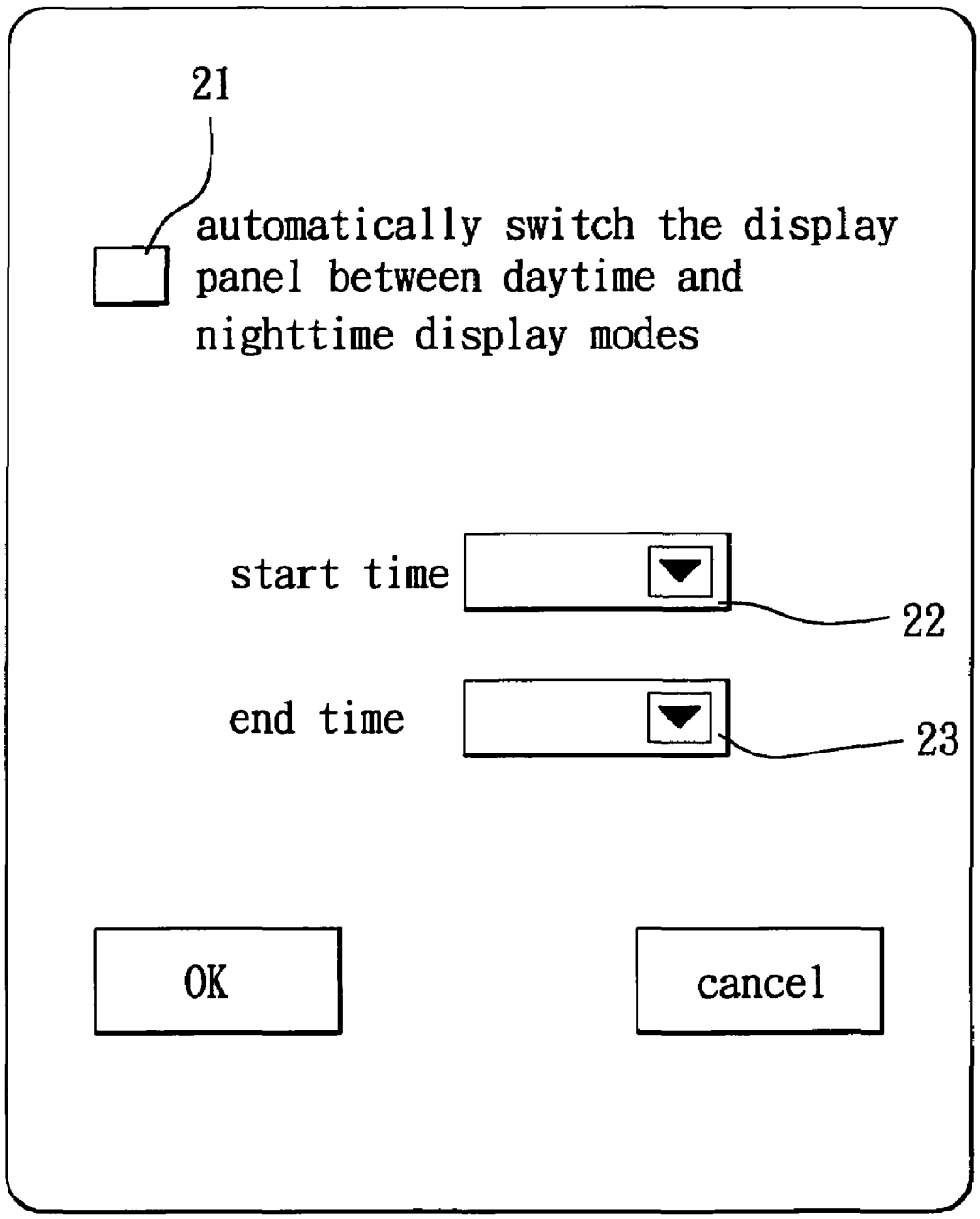
FIG. 3 is a schematic view to illustrate a graphical user interface of the preferred embodiment.

With further reference to FIG. 3, the user input unit 13 includes a graphical user interface (GUI). The display panel 12 is further controlled by the microprocessor 11 in a known manner so as to show the GUI. As illustrated in FIG. 3, the GUI has a checkbox 131 that provides the user an option to enable the microprocessor 11 to automatically switch operation of the display panel 12 between the daytime and nighttime display modes. In addition, the GUI has drop down list boxes 132, 133 that permit the user to select the desired start and end times.

The display mode control method further includes the steps of enabling user configuration of the start and end times through the aforementioned GUI, and enabling the microprocessor 11 to perform steps 21 to 26 after user configuration of the start and end times.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A display mode control method to be implemented in an electronic device having a display panel for showing navigational map information, comprising the steps of:

a) enabling the electronic device to determine the time of day; and b) enabling the electronic device to operate the display panel in a nighttime display mode when the time of day corresponds to nighttime, and in a daytime display mode when the time of day is otherwise;

wherein the navigational map information is shown on the display panel in a light shade against a dark background when the display panel is operated in the nighttime display mode, and in a dark shade against a light background when the display panel is operated in the daytime display mode.

2. The display mode control method as claimed in claim 1, wherein, in step b), the electronic device enables operation of the display panel in the nighttime display mode when the time of day is within a predetermined time period corresponding to nighttime, and in the daytime display mode when the time of day is otherwise.

3. The display mode control method as claimed in claim 2, wherein the predetermined time period is defined by start and end times.

4. The display mode control method as claimed in claim 3, wherein the start and end times are user configurable.

* * * * *